US005812672A

United States Patent [19]

Herre et al.

[11] Patent Number: 5,812,672

[45] Date of Patent: Sep. 22, 1998

[54] METHOD FOR REDUCING DATA IN THE TRANSMISSION AND/OR STORAGE OF DIGITAL SIGNALS OF SEVERAL DEPENDENT CHANNELS

[75] Inventors: Juergen Herre; Dieter Seitzer, both of Erlangen, Germany

[73] Assignee: Fraunhofer-Ges, Germany

[21] Appl. No.: 211,547

[22] PCT Filed: Oct. 13, 1992

[86] PCT No.: PCT/DE92/00869

§ 371 Date: Dec. 15, 1994

§ 102(e) Date: Dec. 15, 1994

[87] PCT Pub. No.: WO93/09644

PCT Pub. Date: May 13, 1993

[30] Foreign Application Priority Data

Nov. 8, 1991 [DE] Germany ..... 41 36 825.8

[51] Int. Cl.[6] ..... H04H 5/00

[52] U.S. Cl. ..... 381/2; 395/2.12; 395/2.14; 395/2.38; 381/1; 381/22; 381/23

[58] Field of Search ..... 381/1–2, 106, 381/29, 30, 17–19, 22–23, 107; 358/408; 333/14; 395/2.12, 2.14, 2.38

[56] References Cited

U.S. PATENT DOCUMENTS

| | | | |
|---|---|---|---|
| 3,647,949 | 3/1972 | Closs | 358/408 |
| 4,803,727 | 2/1989 | Holt | 381/2 |
| 4,841,573 | 6/1989 | Fujita | 381/106 |
| 5,105,463 | 4/1992 | Veldhuis | 381/30 |
| 5,539,829 | 7/1996 | Lokhoff | 381/2 |
| 5,606,618 | 2/1997 | Lokhoff | 381/2 |

FOREIGN PATENT DOCUMENTS

| | | |
|---|---|---|
| 8 908 357 | 9/1989 | WIPO . |
| 9 016 136 | 12/1990 | WIPO . |

OTHER PUBLICATIONS

Robbert G. van der et al. "Subband Coding of Stereophonic Digital Audio Signals", IEEE 1991, pp. 3601 to 3604.

J.D. Johnston, "Perceptual Transform Coding of Wideband Stereo Signals", IEEE, 1989, pp. 1993–1996.

Raymond N.J. Veldhuis et al., "Subband Coding of Digital Audio Signals Without Loss of Quality", IEEE 1989, pp. 2009 to 2012.

*Primary Examiner*—Curtis A. Kuntz
*Assistant Examiner*—Duc Nguyen
*Attorney, Agent, or Firm*—Evenson, McKeown, Edwards & Lenahan, P.L.L.C.

[57] ABSTRACT

A method for reducing data during the transmission and/or storage of the digital signals of several dependent channels is described in which the dependence of the signals in the channels, e.g. in a left and a right stereo channel, can be used for an additional data reduction. Instead of known methods such as middle/side encoding or the intensity stereo process that lead to perceptible interference in the case of an unfavourable signal composition, the method according to the invention avoids such interference, in that a common encoding of the channels only takes place if there is an adequate spectral similarity of the signals in the two channels. An additional data reduction can be achieved in that in those frequency ranges where the spectral energy of a channel does not exceed a predeterminable fraction of the total spectral energy, the associated spectral values are set at zero.

16 Claims, 1 Drawing Sheet

METHOD FOR REDUCING DATA IN THE TRANSMISSION AND/OR STORAGE OF DIGITAL SIGNALS OF SEVERAL DEPENDENT CHANNELS

BACKGROUND AND SUMMARY OF THE INVENTION

The invention relates to a method for reducing data in the transmission and/or storage of digital signals of several dependent channels in which scanning values of signals from the time range are transferred blockwise into the frequency range (in spectral values), the spectral value are encoded, transmitted and/or stored, decoded and transmitted back in several channels in the time range.

Methods in which e.g. audio signals are transmitted in frequency-coded manner, are e.g. known from PCT publications WO88/01811 and WO89/08357. Express reference is made to these documents for explaining terms which are not clarified here.

Many known methods for data-reduced coding of digital audio signals code the signals in the frequency range and use for the transmission of the signals from the time range into the frequency range (in spectral values) a suitable imaging procedure, e.g. a FFT, DCT, MDCT, polyphase filter bank or hybrid filter bank.

These methods lead to a high degree of utilization of signal redundancy and irrelevance with respect to the characteristics of the human ear. If during the transmission of signals of several channels the signals are not independent of one another, an additional reduction of the data quantity to be transmitted is possible. This requirement is [e.g.] fulfilled in the case of signals in the channels of a quadraphonic or stereophonic audio signal.

A method for the utilization of the redundancy/irrelevance between the two channels of a stereo audio signal is described in the publication by J. D. Johnston, "Perceptual Transform Coding of Wideband Stereo Signals", IEEE, 1989, pp. 1993–1996. In this so-called MS coding (middle/side coding) instead of the left and right channel the sum (=center) and the difference (=side) of the stereo signal is coded. This leads to a saving in the quantity of data to be transmitted.

The dependence of signals of two stereo channels is also utilized in the intensity stereo process known from "Subband Coding of Stereophonic Digital Audio Signals", IEEE 1991, pp.3601 to 3604. In this process the monosignal and an additional information concerning the left/right distribution of the signal are transmitted.

As a result of both these procedures in the case of an unfavorable signal composition high interference levels can occur. For example, a very differing signal composition in the left and right channels in MS coding leads to defects which are not concealed by the signal present in the channel. Therefore [e.g.]a loud saxophone signal, which is almost only contained in the right channel, leads to interference on the left channel, which is not concealed and which can therefore be clearly heard. When using the intensity stereo method the spatial sound impression is lost if the left and right channels have a widely differing spectral composition.

Thus, the known methods are only usable if no unfavorable signal composition is to be expected, or if interference can be accepted in favor of reducing the data quantity.

An object of the invention is to provide a method for reducing data in the transmission and/or storage of digital signals of several dependent channels, in which the dependence of the signals in the different channels is utilized and which does not lead to a subjectively perceivable interference of the transmitted signals.

The present invention achieves this object by providing a method for reducing data during the transmission and/or storage of digital signals from N dependent channels, in which scanning values of signals from the time range are transformed blockwise into the frequency rangein spectral values, the spectral values are encoded, transmitted and/or stored, decoded and transmitted back in N channels in the time range, comprising: determining from the spectral values of corresponding blocks of the different channels a quantity which is a measure for the spectral distance between signals of the different channels, and comparing the quantity with a predetermined threshold and performing a common encoding of the signals from the different channels upon the quantity dropping below the threshold.

According to the invention the signals of the different channels are firstly transferred into spectral ranges. Then, from the spectral values, which belong to the corresponding blocks of the channels, a quantity is determined and this constitutes a measure for the spectral distance between the signals. The more similar the spectral values of the corresponding blocks the smaller this quantity. If this quantity drops below a predetermined threshold, the encoding of the signals no longer takes place separately in the individual channels and instead a common encoding takes place. The common encoding takes place according to known processes, which leads to a reduction of the quantity of data to be transmitted.

On exceeding the predetermined threshold a common encoding of the signals of the different channels is no longer performed. Therefore, in favor of the quality of the transmitted data, temporarily there is no additional data reduction.

In certain embodiments, all the spectral values belonging to a block are not used for determining the spectral distance. Instead the spectral distance is determined from frequency range parts, so that several values of the spectral distance per block are determined. Therefore this method reacts more quickly to changes in the spectral distance.

According to certain embodiments, the method according to the invention can be used with particular advantage on signals from two acoustic stereo channels. For this case a preferred instruction for the determination of a quantity is given, which represents a measure for the spectral distance.

If the spectral spacing or distance SD/SE standardized for the spectral energy is below a threshold constant c, it is ensured that the spectral similarity is adequate for a common coding of the two channels. Then the masking thresholds for both channels to be determined according to psychoacoustics are also similar enough to ensure that defects occurring during common coding are effectively masked in both channels.

An alternative rule for determining the spectral distance is provided in certain embodiments of the invention. The threshold constant c is to be determined empirically and is between 0.5 and 1 according to certain embodiments.

Particularly advantageous developments of the common coding or encoding are provided by the present invention. In an exemplary embodiment, the common coding takes place by a per se known middle/side coding. This method is preferably used if importance is attached to maximum quality for low bit rates. A simple method according to certain embodiments uses intensity stereo coding.

From the spectral values of corresponding frequency range parts of the different channels, quantities are determined which represent a measure for the spectral energy of these frequency range parts. These spectral energies of the different channels are compared with the total spectral energy of all the channels.

In the channels in which in a frequency range part the spectral energy drops below a predetermined fraction of the total spectral energy of all the channels in this part, the value 0 is associated with the corresponding spectral values. This method is then particularly advantageous if the number of bits used for the transmission is adapted to the spectral values to be transmitted. The desired data saving then occurs, because zeros can be transmitted with a particularly low bit number.

In other embodiments, the method is used on individual spectral values. Thus, in individual channels, prior to transmission it is possible to cut from the overall spectrum extremely narrow frequency lines, which would in any case not be perceived by the psychoacoustic effect of masking.

In certain embodiments of the method of the present invention, signals from two acoustic channels are transmitted, which are formed by matrixing from stereo signals. This method operates particularly effectively if by the matrixing [according to claim 11] a middle/side coding is brought about. Particularly in the case of stereo signals, which are characterized by a high spectral similarity of the two channels, with middle/side coding different spectral energies occur in the middle and in the side channel. In this case small frequency coded values in the side channel can be replaced by zero without subjectively perceivable interference occurring. However, the method is also usable for the middle channel, if the side channel has a sufficiently high spectral energy compared with the middle channel.

Advantageous rules for the selection of spectral values which are set at zero are provided in certain embodiments. Whereas according to one embodiment in each case individual spectral values are used for determining the spectral energies, the method according to another embodiment operates with pairs of spectral values. This method is advantageously used if, for transmission purposes, use is made of a two-dimensional coding, in which pairs of adjacent spectral values are jointly coded. Obviously the instruction given can also be extended to multi-dimensional coding methods.

The threshold factor k essential for the selection of spectral values set at zero, is a freely determinable factor, which is empirically optimized.

According to certain embodiments different threshold factors are determined for different frequency ranges, so that better account is taken of the characteristics of the human ear.

When transmitting digital audio signals generally a psychoacoustic model is used for calculating a masking threshold. As the masking threshold is a measure of which components of an acoustic signal can be perceived by the human ear, according to certain embodiments the threshold factor is derived from the masking threshold. The masking threshold is a time-variable quantity, which is continuously adapted to the threshold factor. This method makes it possible to obtain an optimum data reduction with respect to the perceivability in the decoded signal. In the case of particularly critical frequency ranges with tonal components, there is a conservative treatment of the frequency-coded values, whereas lines are removed from the spectrum in noncritical areas.

The essential advantages of the invention are that without significantly increasing the complexity of the transmission process an additional data reduction is obtained. The method according to the invention is independent of the specific construction of the coding method used and can therefore be employed in a universal manner.

The method merely requires an additional signal processing in the coder, whereof only small numbers are required, on the transmitter side, but not in the decoder, which is used in large numbers by the final consumer.

Other objects, advantages and novel features of the present invention will become apparent from the following detailed description of the invention when considered in conjunction with the accompanying drawings.

DETAILED DESCRIPTION OF THE DRAWINGS

Figure 1A:
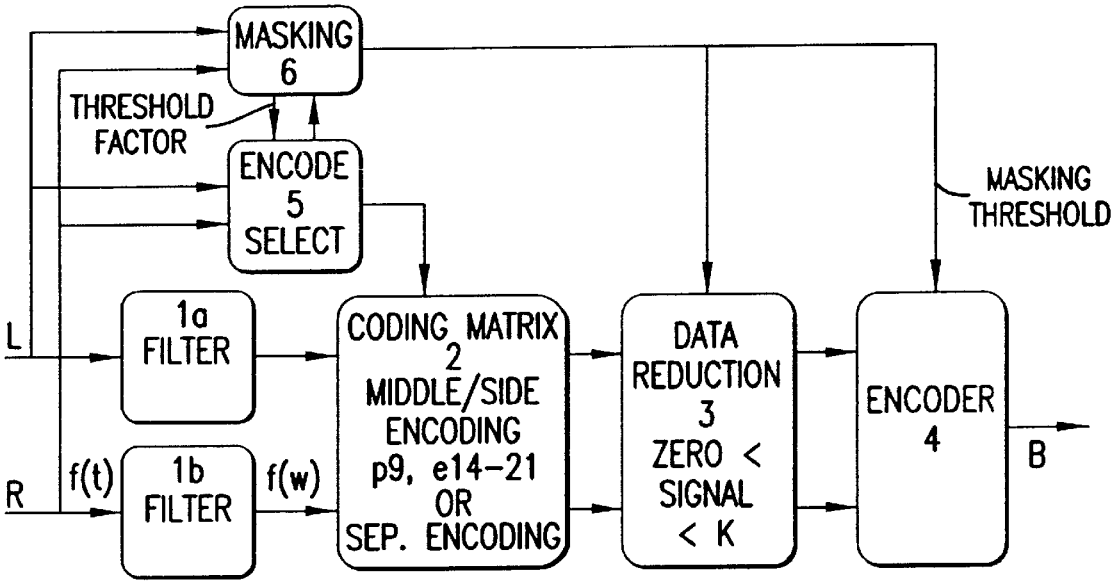
FIG. 1*a* illustrates a block circuit diagram of a method according to the invention for encoding.

The time signals of a left-hand stereo channel L and a right-hand stereo channel R are transformed into the frequency range in analysis filter banks 1*a,* 1*b* and for this purpose several methods are available such as FFT, DCT, MDCT, polyphase filter bank, hybrid filter bank, etc.

A coding matrix 2 is used on the signals transformed in the frequency range and this permits a common encoding of the two channels. In the present embodiment middle/side encoding is used.

In the following stage 3 data reduction takes place by eliminating certain frequency ranges. In the side channel or in the middle channel, in frequency ranges in which the signal has a comparatively low spectral energy, corresponding spectral values are set to zero. The signals are then encoded in a two-channel audio data encoder 4, e.g. an entropy encoder and transformed with the aid of a multiplexer into a bit stream.

To control the middle/side encoding, the elimination of the frequency ranges and the audio data encoding the input signals undergo a further analysis. With the aid of a psychoacoustic model in a stage 6 the masking threshold is calculated, this being decisive for audio data encoding 4. From the masking threshold is derived a threshold factor as a condition for which spectral values in which frequency ranges in stage 3 are set to zero.

Figure 1B:
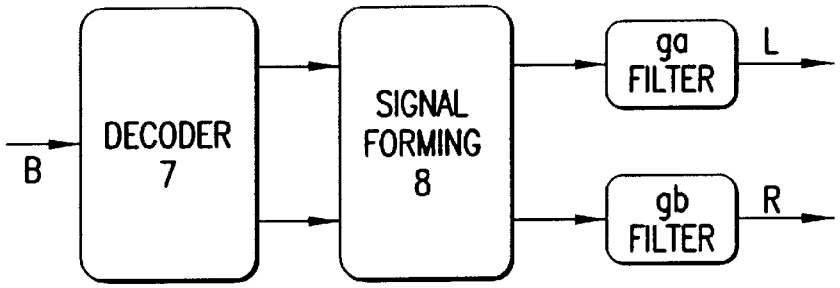
FIG. 1*b* shows a block circuit diagram of a method according to the invention for decoding.

By means of the spectral spacing of the signals in the two channels, determination takes place in stage 5 as to whether there is to be a middle/side encoding for a selected signal portion by using the coding matrix 2. If in the selected signal portion the spectral similarity of the data is too low, in the coding matrix 2 no middle/side encoding takes place and instead both channels are separately encoded. The bit stream formed in the encoder is transmitted to the decoder, whose construction is shown in FIG. 1*b*.

In the decoder and in stage 7 the bit stream is decoded and subsequently in stage 8 from the middle/side-encoded signals the signals of the left and right channels are formed, which in the synthesis filter banks 9*a*, 9*b* are transmitted back from the frequency range into the time range.

The present invention provides a method for reducing data during the transmission and/or storage of digital signals from N dependent channels, in which scanning values of signals from the time range are transformed blockwise into the frequency range in spectral values. The spectral values are encoded, transmitted and/or stored, decoded and transmitted back in N channels in the time range. The method includes the steps of determining from the spectral values of corresponding blocks of the different channels a quantity which is a measure for the spectral distance between signals of the different channels, and comparing this quantity with a predetermined threshold. A common encoding of the signals from the different channels is performed upon the quantity dropping below the threshold.

The method further includes determining the spectral distance between the signals of different channels from corresponding frequency range parts of the signals.

In certain embodiments signals from two acoustic stereo channels and wherein the condition for the common encoding of the signals is described by the following rule $$SD/SE<c,$$

in which SD is a measure for the spectral distance between the signals from the right and left stereo channels and is formed according to the following instruction:

$$SD=\sum_{i=f1}^{f2-1}\left||L_i/LR_RATIO|^n-|R_i|^n\right|$$

in which $L_i$ or $R_i$ are the coefficients of the left or right stereo channel frequency-encoded with the block length IBLEN, n is a freely selectable standard and f1 and f2 are the index limits of the considered frequency interval, the quantity LR_RATIO is the ratio of the signal quantities of the left to the right channel and SE the spectral energy of the stereo signal and which is formed according to the following instruction:

$$SE=\sum_{i=f1}^{f2-1}\left||L_i|^n+|R_i|^n\right|$$

and c is a predeterminable threshold constant with $0<c<1$.

In certain embodiments of the invention, the measure for the spectral distance SD is formed according to the following instruction:

$$SD=\sum_{i=f1}^{f2-1}\left|(|L_i/LR_RATIO|^n-|R_i|)\right|^n$$

In certain embodiments, the threshold constant c is chosen between 0.5 and 1.

The present invention provides certain embodiments in which the common encoding takes place by a middle/side encoding and the quantity LR_RATIO is set at 1.

In certain embodiments, the common encoding takes place by intensity stereo encoding and for the quantity LR_RATIO the following applies:

$$LR_RATIO=\sqrt[n]{\frac{\sum_{i=f1}^{f2-1}|L_i|^n}{\sum_{i=f1}^{f2-1}|R_i|^n}}$$

In certain embodiments, from the spectral values of corresponding frequency range parts of the different channels, quantities are determined which represent a measure for the spectral energy of these frequency range parts. These quantities of the different channels are compared with the spectral energy of all the channels in these frequency range parts. In frequency range parts in which the spectral energy in individual channels drops below a predeterminable fraction of the total energy of all the channels, the corresponding spectral values of the frequency range parts are set at zero.

In certain embodiments, individual spectral values from the different channels are used for determining the spectral energy.

Embodiments of the present invention also provide that signals from two acoustic channels are transmitted, which are formed by matrixing from the signals of a left and a right channel of a stereo signal. The matrixing is a middle/side encoding, for example.

Certain embodiments provide that spectral values S in the difference channel ($S_i=L_i-R_i$) or in the sum channel ($S_i=L_i+R_i$) are replaced by the value zero in accordance with the following instruction:

$$\text{if } |S_i|^n<k^*(|L_i|^n+|R_i|^n),$$

$$\text{then } S_i:=0$$

in which Lj or Rj are the coefficients of the left or right stereo channel frequency encoded with the block length IBLEN, n is a freely selectable standard and k is an appropriately chosen threshold factor, i running from 0 to the block length IBLEN exclusively.

In certain embodiments, the method provides that for determining the spectral energy, use is made of pairs of scanning values, and the spectral values $S_{2i}$ and $S_{2i+1}$, in the difference channel or in the sum channel are set to the value zero according to the following instruction:

$$\text{if } |S_{2i}{}^n+S_{2+1}{}^n|<k^*(|L_{2i}|^n+|R_{2i}|^n+|L_{2i+1}|^n+|R_{2i+1}|^n),$$

$$\text{then } S_{2i}=0 \text{ and } S_{2i+1}:=0$$

in which the index i runs from zero to half the block length IBLEN exclusively. The threshold factor k is chosen differently in different frequency ranges, according to certain embodiments.

In certain embodiments of the invention, in encoding the spectral values use is made of a psychoacoustic model for the calculation of a masking threshold and the threshold factor k is derived in adaptive manner from this masking threshold.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. Method for diminishing cross channel interference in a data reduction process during the transmission and storage of information in N dependent channels, each channel comprising a channel signal having a frequency range which includes a plurality of frequency range parts, in which method scanning values of said channel signals in the time domain are transformed blockwise into the frequency domain, thereby providing respective spectral values for said range parts, the spectral values are encoded, transmitted and/or stored, decoded and transformed back into N channel signals in the time domain, comprising:

determining a single quantity which is a measure of the overall spectral separation between the different channel signals, based on the spectral values for corresponding blocks of the different channel signals;

comparing the quantity with a predetermined threshold;

performing common encoding of said channel signals when the quantity falls below the threshold; and performing separate encoding of said channel signals when the quantity exceeds the threshold.

2. Method according to claim 1, further comprising determining the spectral distance between the signals of different channels from corresponding frequency domain parts of the signals.

3. Method for reducing data during the transmission and/or storage of digital signals from N dependent channels, in which scanning values of signals from the time domain are transformed blockwise into the frequency domain in spectral values, the spectral values are encoded, transmitted and/or stored, decoded and transmitted back in N channels in the time domain, comprising: determining from the spectral values of corresponding blocks of the different channels a quantity which is a measure for the spectral distance between signals of the different channels; comparing the quantity with a predetermined threshold; performing a common encoding of the signals from the different channels upon the quantity dropping below the threshold; further comprising determining the spectral distance between the signals of different channels from corresponding frequency domain parts of the signals; and further comprising transmitting signals from two acoustic stereo channels and wherein the condition for the common encoding of the signals is described by the following rule $$SD/SE<c,$$

in which SD is a measure for the spectral distance between the signals from the right and left stereo channels and is formed according to the following instruction:

$$SD=\sum_{i=f1}^{f2-1}\left||L_i/LR_RATIO|^n-|R_i|^n\right|$$

in which $L_i$ or $R_i$ are the coefficients of the left or right stereo channel frequency-encoded with the block length IBLEN, n is a freely selectable standard and f1 and f2 are the index limits of the considered frequency interval, the quantity LR_RATIO is the ratio of the signal quantities of the left to the right channel and SE the spectral energy of the stereo signal and which is formed according to the following instruction:

$$SE=\sum_{i=f1}^{f2-1}\left||L_i|^n+|R_i|^n\right|$$

and c is a predeterminable threshold constant with 0<c<1.

4. Method according to claim 3, wherein the measure for the spectral distance SD is formed according to the following instruction:

$$SD=\sum_{i=f1}^{f2-1}\left|(|L_i/LR_RATIO|^n-|R_i|)\right|^n$$

5. Method according to claim 4, wherein the threshold constant c is chosen between 0.5 and 1.

6. Method according to claim 5, wherein the common encoding takes place by a middle/side encoding and the quantity LR_RATIO is set at 1.

7. Method according to claim 5, wherein the common encoding takes place by intensity stereo encoding and for the quantity LR_RATIO the following applies:

$$LR_RATIO=\sqrt[n]{\frac{\sum_{i=f1}^{f2-1}|L_i|^n}{\sum_{i=f1}^{f2-1}|R_i|^n}}\ .$$

8. Method for reducing data during the transmission and/or storage of digital signals from N dependent channels, in which scanning values of signals from the time domain are transformed blockwise into the frequency domain in spectral values, the spectral values are encoded, transmitted and/or stored, decoded and transmitted back in N channels in the time domain, comprising: determining from the spectral values of corresponding blocks of the different channels a quantity which is a measure for the spectral distance between signals of the different channels; comparing the quantity with a predetermined threshold; performing a common encoding of the signals from the different channels upon the quantity dropping below the threshold; and further comprising determining from the spectral values of corresponding frequency domain parts of the different channels quantities which represent a measure for the spectral energy of these frequency domain parts, comparing these quantities of the different channels with the spectral energy of all the channels in these frequency domain parts and wherein in frequency domain parts in which the spectral energy in individual channels drops below a predeterminable fraction of the total energy of all the channels, the corresponding spectral values of the frequency domain parts are set at zero.

9. Method according to claim 8, wherein individual spectral values from the different channels are used for determining the spectral energy.

10. Method according to claim 8, wherein signals from two acoustic channels are transmitted, which are formed by matrixing from the signals of a left and a right channel of a stereo signal.

11. Method according to claim 10, wherein the matrixing is a middle/side encoding.

12. Method according to claim 11, further comprising replacing spectral values S in the difference channel ($S_i=L_i-R_i$) or in the sum channel ($S_i=L_i+R_i$) by the value zero in accordance with the following instruction:

$$\text{if } |S_i|^n<k^*(|L_i|^n+|R_i|^n),$$

$$\text{then } S_i:=0$$

in which Lj or Rj are the coefficients of the left or right stereo channel frequency encoded with the block length IBLEN, n is a freely selectable standard and k is an appropriately chosen threshold factor, i running from 0 to the block length IBLEN exclusively.

13. Method according to claim 11, wherein for determining the spectral energy use is made of pairs of scanning values and the spectral values $S_{2i}$ and $S_{2i+1}$, in the difference channel or in the sum channel are set to the value zero according to the following instruction:

$$\text{if } |S_{2i}{}^n+S_{2+1}{}^n|<k^*(|L_{2i}|^n+|R_{2i}|^n+|L_{2i+1}|^n+|R_{2i+1}|^n),$$

$$\text{then } S_{2i}=0 \text{ and } S_{2i+1}:=0,$$

in which the index i runs from zero to half the block length IBLEN exclusively.

14. Method according to claim 13, wherein the threshold factor k is chosen differently in different frequency domains.

15. Method according to claim 14, wherein in encoding the spectral values use is made of a psychoacoustic model for the calculation of a masking threshold and the threshold factor k is derived in adaptive manner from this masking threshold.

16. A method for diminishing cross channel interference in a data reduction process during the transmission and storage of digital signals from N dependent channels, the method comprising the steps of:

transforming blockwise scanning values of signals from the time domain into the frequency domain in spectral values, said spectral values being encoded, transmitted and/or stored, decoded and transmitted back in N channels in the time domain;

determining a single quantity which is a measure for an overall spectral separation between the different channels, based on the spectral values for corresponding blocks of the different channels;

comparing the quantity with a predetermined threshold;

performing common encoding of said channels when the quantity falls below the predetermined threshold; and performing separate encoding of said channels when the quantity exceeds the threshold.

* * * * *